US011530862B2

(12) United States Patent
Malin

(10) Patent No.: US 11,530,862 B2
(45) Date of Patent: Dec. 20, 2022

(54) LOW-TEMPERATURE STORAGE PLANT WITH A NITROGEN WITHDRAWAL APPARATUS

(71) Applicant: LICONIC AG, Mauren (LI)

(72) Inventor: Cosmas Malin, Mauren (LI)

(73) Assignee: LICONIC AG, Mauren (LI)

( * ) Notice: Subject to any disclaimer, the term of this patent is extended or adjusted under 35 U.S.C. 154(b) by 819 days.

(21) Appl. No.: 16/151,857

(22) Filed: Oct. 4, 2018

(65) Prior Publication Data

US 2019/0107315 A1 Apr. 11, 2019

(30) Foreign Application Priority Data

Oct. 5, 2017 (CH) ..... 01225/17

(51) Int. Cl.

| | |
|---|---|
| ***B01L 1/00*** | (2006.01) |
| ***B01L 7/00*** | (2006.01) |
| ***F25D 3/10*** | (2006.01) |
| ***F25B 19/00*** | (2006.01) |
| ***B01L 1/02*** | (2006.01) |
| ***B65D 81/38*** | (2006.01) |
| *F25D 29/00* | (2006.01) |

(52) U.S. Cl.

CPC ..... *F25D 3/105* (2013.01); *B01L 1/025* (2013.01); *B01L 7/00* (2013.01); *B65D 81/3806* (2013.01); *F25D 3/102* (2013.01); *B01L 2300/10* (2013.01); *F25D 29/001* (2013.01)

(58) Field of Classification Search

CPC ..... F25B 19/00; F25B 19/005; F25J 1/0025; F17C 2265/03; F17C 2265/031; F17C 2265/032; F25D 17/047; F25D 13/06; F25D 13/062; F25D 13/065; F25D 13/067; F25D 3/10; F25D 21/00; B01L 1/025; B01L 7/00; B01L 2300/10; B65D 81/3806

See application file for complete search history.

(56) References Cited

U.S. PATENT DOCUMENTS

| | | | | |
|---|---|---|---|---|
| 2,966,040 A * | 12/1960 | Henry | F17C 6/00 | 62/47.1 |
| 3,691,781 A * | 9/1972 | Edwards, Jr. | F25C 1/00 | 62/51.1 |
| 4,218,892 A * | 8/1980 | Stephens | F17C 3/085 | 165/104.26 |
| 4,276,753 A | 7/1981 | Sandberg et al. | | |
| 4,441,327 A * | 4/1984 | Klee | F25D 3/11 | 236/102 |

(Continued)

OTHER PUBLICATIONS

Europe Search Report Conducted in Europe counterpart Appln. No. 18192864.9 (dated Mar. 13, 2019).

(Continued)

*Primary Examiner* — Miguel A Diaz
*Assistant Examiner* — Erik Mendoza-Wilkenfel
(74) *Attorney, Agent, or Firm* — Greenblum & Bernstein, P.L.C.

(57) ABSTRACT

A storage plant for storing objects at the temperature of liquid nitrogen comprises a plurality of storage tanks arranged in a cooled chamber. A nitrogen withdrawal apparatus is provided to carry off evaporated nitrogen directly from the storage tanks before it can enter the chamber. The pressure in the storage tanks is kept below the pressure in the chamber.

4 Claims, 4 Drawing Sheets

(56) References Cited

U.S. PATENT DOCUMENTS

| | | | | |
|---|---|---|---|---|
| 5,220,800 | A * | 6/1993 | Muller | G01R 33/3815 62/51.1 |
| 5,469,712 | A * | 11/1995 | Sitte | F17C 3/085 62/51.1 |
| 5,661,980 | A * | 9/1997 | Gallivan | F28F 13/02 62/51.1 |
| 10,047,978 | B1 * | 8/2018 | Moon | F25B 19/005 |
| 2008/0104976 | A1 * | 5/2008 | Guglielmetti | F25D 29/001 62/127 |
| 2011/0271694 | A1 * | 11/2011 | Strobel | H01F 6/04 62/51.1 |
| 2012/0134898 | A1 | 5/2012 | Malin | |
| 2014/0190977 | A1 * | 7/2014 | Malin | B65D 81/38 220/592.2 |
| 2015/0289500 | A1 * | 10/2015 | Fuhr | B01L 7/50 62/48.2 |
| 2017/0234597 | A1 | 8/2017 | Moon et al. | |

OTHER PUBLICATIONS

Europe Office Action Conducted in Europe counterpart Appln. No. 18192864.9 (dated May 27, 2022).

* cited by examiner

LOW-TEMPERATURE STORAGE PLANT WITH A NITROGEN WITHDRAWAL APPARATUS

CROSS REFERENCE TO RELATED APPLICATIONS

This application claims priority of Swiss patent application 01225/17, filed Oct. 5, 2017, the disclosure of which is incorporated herein by reference in its entirety,

TECHNICAL FIELD

The invention relates to storage plant for storing objects at a temperature close to the boiling point of liquid nitrogen as well as to a method for operating such a storage plant.

BACKGROUND OF THE INVENTION

US 2014/0190977 and US 2012/0134898 de-scribe storage plants for the storage of objects at cryogenic temperatures. They comprise a chamber maintained at a temperature below 0° C. and a plurality of storage tanks arranged therein. Each storage tank is supplied with liquid nitrogen in order to cool the objects stored therein to a temperature below −160° C.

In order to protect the user of such a plant from hypoxia, entrance to the chamber while the plant is operating must be prohibited, or the air with-in the chamber must be replaced regularly in order to remove nitrogen leaking from the tanks. The latter causes substantial problems, not only because of the energy required to cool down the fresh air to be fed the chamber, but also because the fresh air needs to be dried before can be used.

BRIEF SUMMARY OF THE INVENTION

Hence, it is a general object of the invention to provide a storage plant of this type, as well as a method for operating the same, which alleviate the problems arising when removing the nitrogen leaking from the tanks.

Now, in order to implement these and still further objects of the invention, which will become more readily apparent as the description proceeds, the storage plant comprises a chamber, a chamber cooling unit adapted and structured for cooling said chamber, at least one storage tank arranged in said chamber for receiving objects to be stored, at least one tank cooling unit adapted and structured to feed liquid nitrogen to said tank, a nitrogen withdrawal apparatus comprising a) at least one withdrawal duct connected to top section of said tank, b) a least one exhaust duct extending away from said chamber, and c) at least one pump opera table to move gaseous nitrogen from said tank through said withdrawal duct and said exhaust duct for conveying it away from said chamber.

Advantageously, it comprises

A chamber This is the chamber holding the one or more storage tanks as described below.

A chamber cooling unit: This is a device adapted and structured for cooling said chamber.

At least one storage tank arranged in said chamber: The storage tank is provided for receiving objects to be stored.

At least one tank cooling unit: This is the unit that cools down the tank to its operating temperature. To do so, it is adapted and structured to feed liquid nitrogen to the tank. There may be one or more tank cooling units to cool the tank(s).

A nitrogen withdrawal apparatus: The purpose of this apparatus is to withdraw nitrogen from the storage plant in order to keep the chamber safe for human access. The nitrogen withdrawal apparatus comprises the following components:

a) At least one withdrawal duct connected to the top section of the tank: This duct is used to withdraw gaseous nitrogen from the tank.

b) At least one exhaust duct extending away from said chamber: This duct is used to convey the gaseous nitrogen out of the chamber and, advantageously, out of the building the chamber is located in.

c) A pump: This pump is used to actively suck the gaseous nitrogen from the tank and to convey it outside, i.e. it is opera table to move gaseous nitrogen from the tank through the withdrawal duct and the exhaust duct in order to convey it away from said chamber.

The invention also relates to a method for operating the storage plant in a building. The method comprises the step of withdrawing gaseous nitrogen from said at least one storage tank and conveying it out of said building by means of said nitrogen withdrawal apparatus.

The invention is based on the understanding that it is easier to directly withdraw excess gaseous nitrogen from the tanks and to convey it out of the chamber and, advantageously, out of the surrounding building than to try to air the chamber in order to keep nitrogen levels therein As mentioned, the withdrawal duct is connected to a top section of the tank. Advantageously, its intake end (mouth) is positioned at the top 25%, in particular at the top 10%, of the tank's interior space, in order to withdraw only the warmest nitrogen and to keep temperature within the tank low.

Advantageously, the storage plant comprises a plurality of storage tanks in said chamber and the nitrogen withdrawal apparatus comprises a plurality of withdrawal ducts, with at least one withdrawal duct connected to each of said tanks. This design provides an individual withdrawal of nitrogen from each tank.

In another advantageous embodiment, the nitrogen withdrawal apparatus comprises a plurality of said pumps for redundancy. In that case, in a particularly advantageous embodiment, the nitrogen withdrawal apparatus comprises a plurality of exhaust ducts, wherein at least one pump is attributed to each exhaust duct. This design further improves the plant's reliability.

Advantageously, the nitrogen withdrawal apparatus comprises at least one manifold connected to more than one of said withdrawal ducts and/or to more than one of said pumps.

This had the advantage of additional redundancy.

In yet another advantageous embodiment, the plant further comprises an air dryer unit for drying air to be fed to and/or contained within the chamber. This allows to reduce ice formation within the chamber.

The invention also relates to a building comprising the storage therein. In this case, said at least one exhaust duct is arranged to convey said nitrogen out of the building. This allows to remove the excess nitrogen from the building.

Other advantageous embodiments are listed in the dependent claims as well as in the description below.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Definitions:

The term "a plurality" designates a number larger than 1.

The term "manifold" defines a duct that branches of to a plurality of sub-ducts.

Ts is the storage temperature in the storage tanks 4.

Tc is the chamber temperature in chamber 3.

Figure 1:
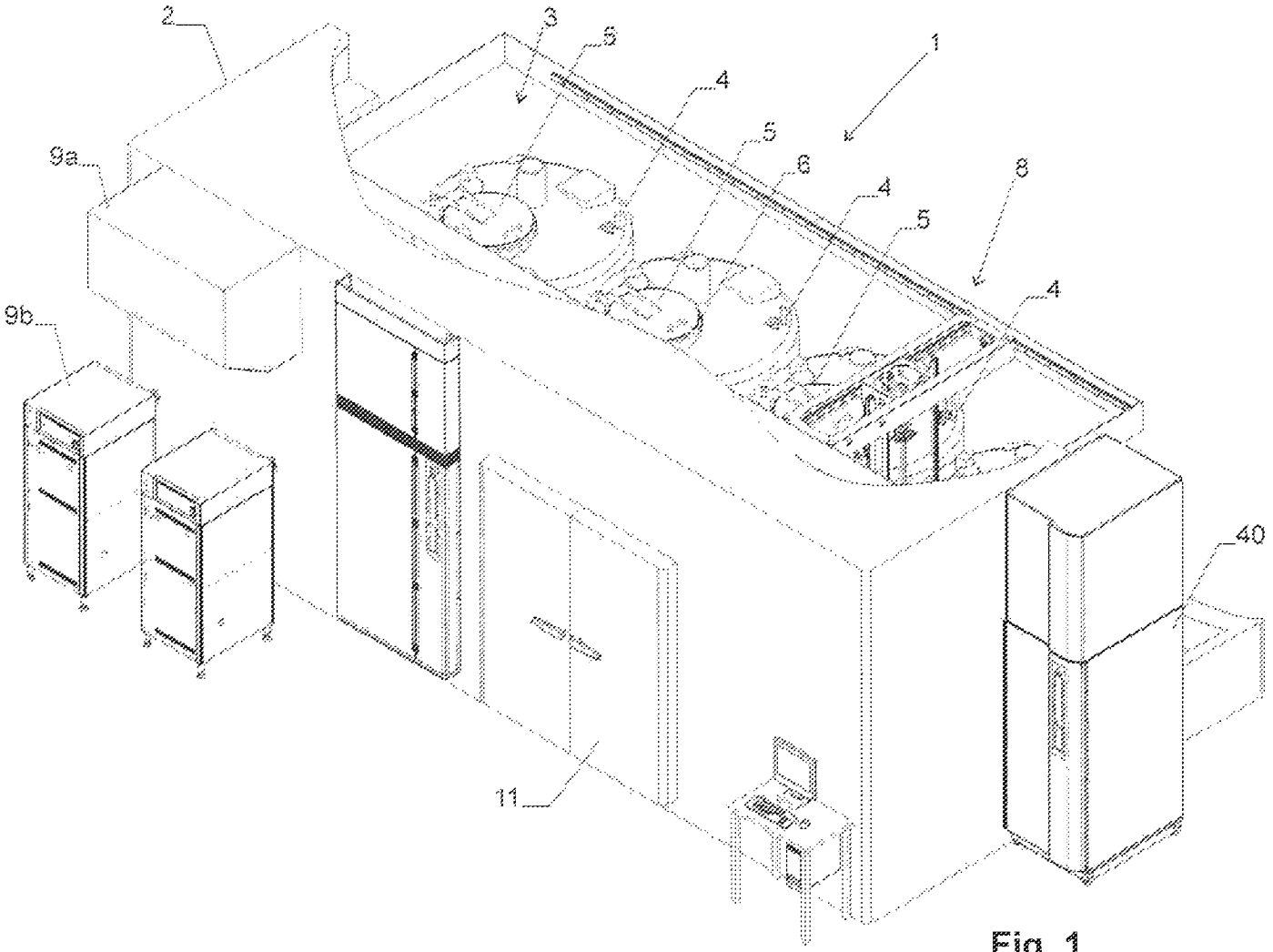
FIG. 1 shows a view of a storage plant with the ceiling of the chamber partially removed.

Storage Plant:

FIG. 1 shows a storage plant 1 for the long-term storage of objects, in particular laboratory objects, such as biological probes or chemical objects, at very low temperatures, in particular at storage temperatures Ts below −160° C., typically at −196° C. Storage plant 1 is designed to automatically store and remove the objects and to move the objects between different storage positions within the storage plant, The objects e.g. comprise test tubes, which in turn are arranged in tube racks. Several of these objects are stored on top of one another in a storage cassette.

The storage plant has an insulated outer wall 2, which encloses a chamber 3. At least one storage tank 4 is arranged in chamber 3. Preferably, multiple storage tanks 4 of this type are provided. Each storage tank 4 is advantageously embodied as a Dewar vessel and has, in a known manner, an evacuated, mirrored insulation wall, which forms a vacuum insulation and has low thermal conductivity.

Figure 2:
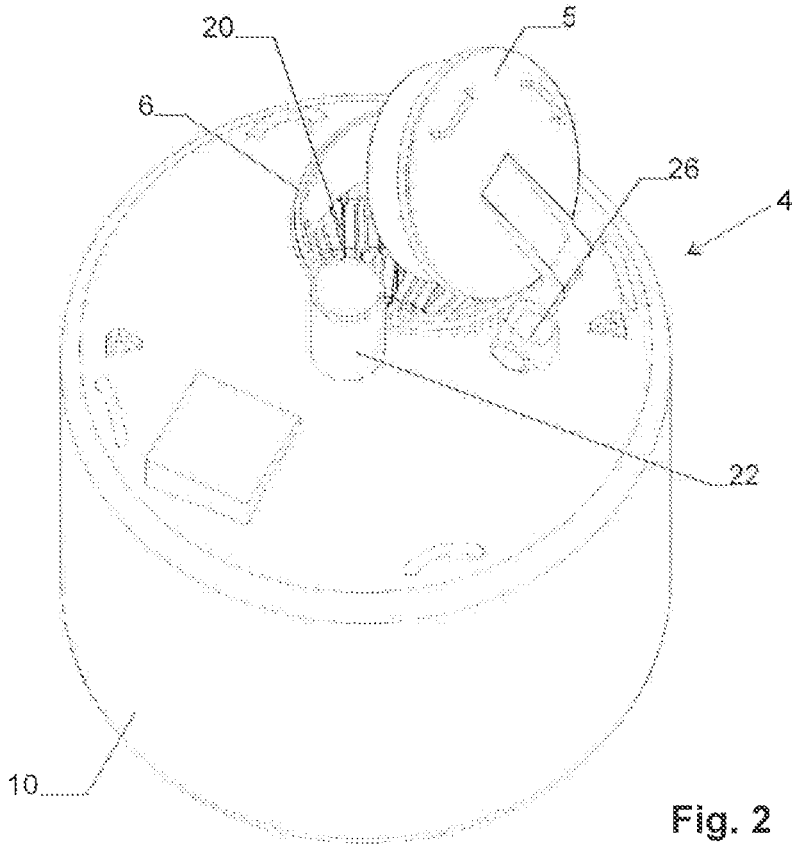
FIG. 2 shows a single storage tank of the storage plan.
Figure 3:
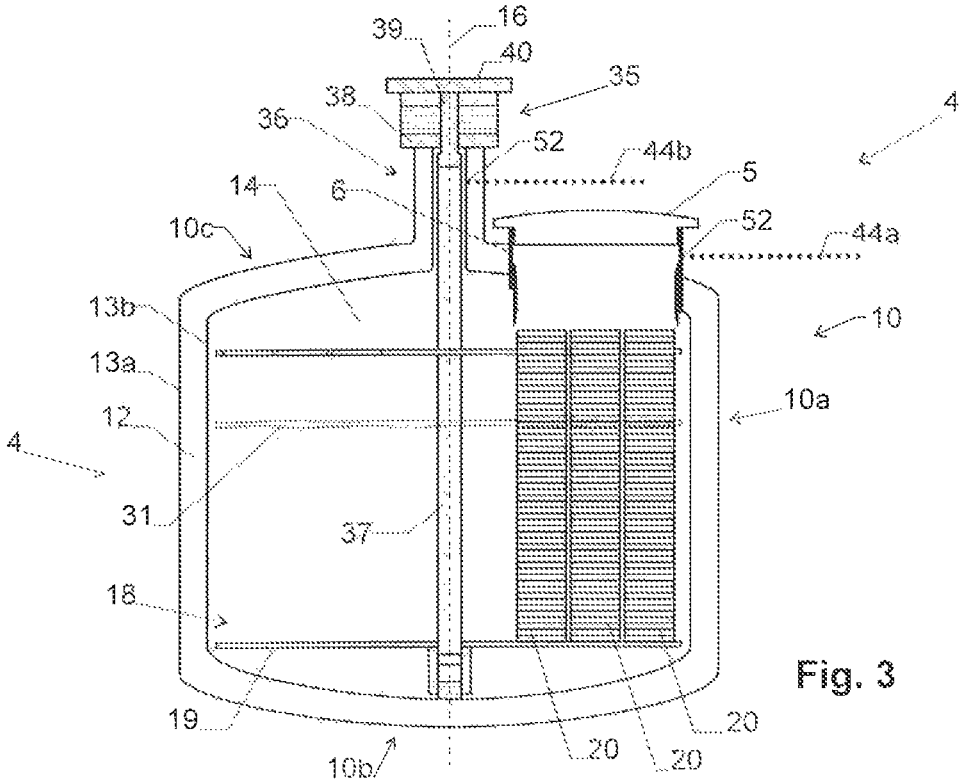
FIG. 3 shows a sectional view of the storage tank.

An embodiment of a storage tank 4 is shown in FIGS. 2 and 3. Storage tank 4 is closed on all sides, and a lid 5 is respectively provided for accessing its interior space. The lid 5 forms a door sealing an access opening 6 located in a top wall 10*c* of storage tank 4.

Chamber 3, as shown in FIG. 1, is a cooling chamber. The temperature To of chamber 3 is advantageously below 0° C., in particular between −20° C. and −50° C. Using such a low temperature reduces the formation of ice in the storage tanks 4 or on the objects. The storage temperature Ts in the storage tanks 4 is less than the chamber temperature Tc and is advantageously, as mentioned, below −160° C., it particular around −196° C.

A handling device 8 is arranged in chamber 3. Handling device 8 is adapted and structured to handle the objects within chamber 3. In particular, it is able to transport objects between the storage tanks 4 and an interface station 40 where objects can be retrieved and provided outside chamber 3.

In the embodiment shown, handling device 8 comprises a transport device for moving the storage cassettes and/or the objects. It is moveably arranged above the storage tanks 4. As can be seen from FIG. 1, a single handling device 8 is advantageously provided to access all storage tanks 4

The storage plant furthermore comprises a chamber cooling unit 9*a* for producing the chamber temperature Tc in chamber 3 as well as a tank cooling unit 9*b* for producing the storage temperature Ts in the tanks 4. Tank cooling unit 9*b* is adapted and structured to feed liquid nitrogen to the tanks 4, Chamber 3 is accessible via a maintenance door 11.

Storage tanks:

An advantageous embodiment of a storage tank 4 is illustrated in FIGS. 2 and 3. It has a housing 10 in which the aforementioned vacuum insulation 12 is arranged between an outer wall 13*a* and an inner wall 13*b*. Vacuum insulation 12 encloses an interior space 14, which accommodates a carrousel 18 rotatable about a vertical rotation axis 16. Carrousel 13 carries, on a base member 19, a plurality of storage cassettes 20, of which three are illustrated in FIG. 3. The storage cassettes 20 are arranged. In at least one, preferably in multiple, concentric circles around the rotation axis 16.

Housing 10 has an essentially cylindrical outer wall 10*a* which laterally encloses interior space 14. The interior space is closed at its bottom end by an essentially horizontal base wall 10*b* and at its top end by an essentially horizontal top wall 10*c*.

A positioning drive 22 (FIG. 2) serves to rotate the carrousel 18 about rotation axis 16 and move the carrousel into defined rotational positions, Lid 5 is adapted to seal access opening 6. It can be opened and closed automatically using a door drive 26. Access opening 6 is arranged on the top side of storage tank 4 in top wall 10*c*. It is positioned and sized such that, with lid 5 opened, each storage cassette 20 that was rotated into the region of access opening 6 by a positioning drive 22 can be removed from above.

Carrousel 18 is rotatably suspended in the storage tank 4, that is, its weight is (by at least 90%) borne by a top rotational bearing 35 that is located above the carrousel. Preferably, top rotational bearing 35 is arranged outside insulation. 12 so that it can be operated at a relatively high temperature.

In the embodiment shown, rotational bearing 35 is located at the top end of a neck portion 36 of storage tank 4. This neck portion 36 projects vertically upwards over top wall 10*c*, advantageously by at least 20 cm. The outer diameter of the neck portion 36 is preferably significantly smaller than the outer diameter of the carrousel, in particular less than 10% of the diameter of the carrousel. insulation 12 extends over top wall 10*c* and neck portion 36 up to the top end of the same so that a thermal bridge is also avoided in neck portion 36, Carrousel 18 has a drive shaft 37, preferably in the form of a hollow tube for reducing thermal conduction. Drive shaft 37 extends through neck portion 36 up to the rotational bearing 35.

Nitrogen Handling:

As mentioned, liquid nitrogen is continuously fed to the storage tanks 4. In each tank 4, the liquid nitrogen will pool at the bottom of interior space 14 and evaporate slowly. The cold gaseous nitrogen rises and keeps the interior space 14 of storage tank 4 cool.

However, since nitrogen is evaporating continuously, it has to be carried off in a safe manner.

For this purpose, the storage plant is equipped with a nitrogen withdrawal apparatus, which will now be described by referring to FIG. 4. This figure shows a schematic top view (with sectioned walls) of a storage plant (albeit with only six storage tanks 4 as compared to the smaller number of storage tanks 4 of the embodiment of FIG. 2). Storage plant 1 is located in a building 42, some walls of which are, by way of example, depicted in FIG. 4.

The nitrogen withdrawal apparatus comprises a plurality of withdrawal ducts 44. In the embodiment of FIG. 4, each storage tank 4 is connected to one withdrawal duct 44, even though it can also be connected to several withdrawal ducts 44 for redundancy reasons.

The withdrawal ducts 44 are connected, on their ends opposite to the tanks 4, to at least one manifold 46. In the embodiment of FIG. 4, there are two such manifolds, each of which is connected to three withdrawal ducts 44.

In addition, each manifold 46 is connected to at least one exhaust duct 48. Advantageously, for redundancy reasons, each manifold 46 is connected to several exhaust ducts 46. In the embodiment of FIG. 4, each manifold 46 is connected to three exhaust ducts 48.

The exhaust ducts lead outside chamber 3 and, advantageously, outside building 42, Further, there is at least one pump 50 that can be operated to withdraw gaseous nitrogen from the tanks 4 through the withdrawal duct 44 and to feed the nitrogen to the exhaust ducts 48 in order to convey it away from chamber 3.

Advantageously, at least one such pump 50 is attributed to each exhaust duct 43. The pumps can e.g. be arranged at the entrance, along the length, or at the exit of the exhaust ducts 48.

FIG. 3 shows two advantageous embodiments for connecting the withdrawal ducts 44 (which are shown in dotted lines 44*a*, 44*b* in that figure) to the storage tanks 4.

In a first embodiment, the intake end 52 of the exhaust duct (which is in this case denoted by reference number 44*a*) is located at the access opening 6, e.g. at its rim or in lid 5.

In another advantageous embodiment, the intake end 52 of the exhaust duct (which is in this case denoted by reference number 44*b*) is located in neck portion 36.

In both these embodiments, withdrawal of excess nitrogen takes place at the top region of the tank's interior space, well above the objects stored therein.

During operation of storage plant 1, the pumps 50 are running intermittently or continuously in order to carry of the slowly evaporating nitrogen.

Figure 4:
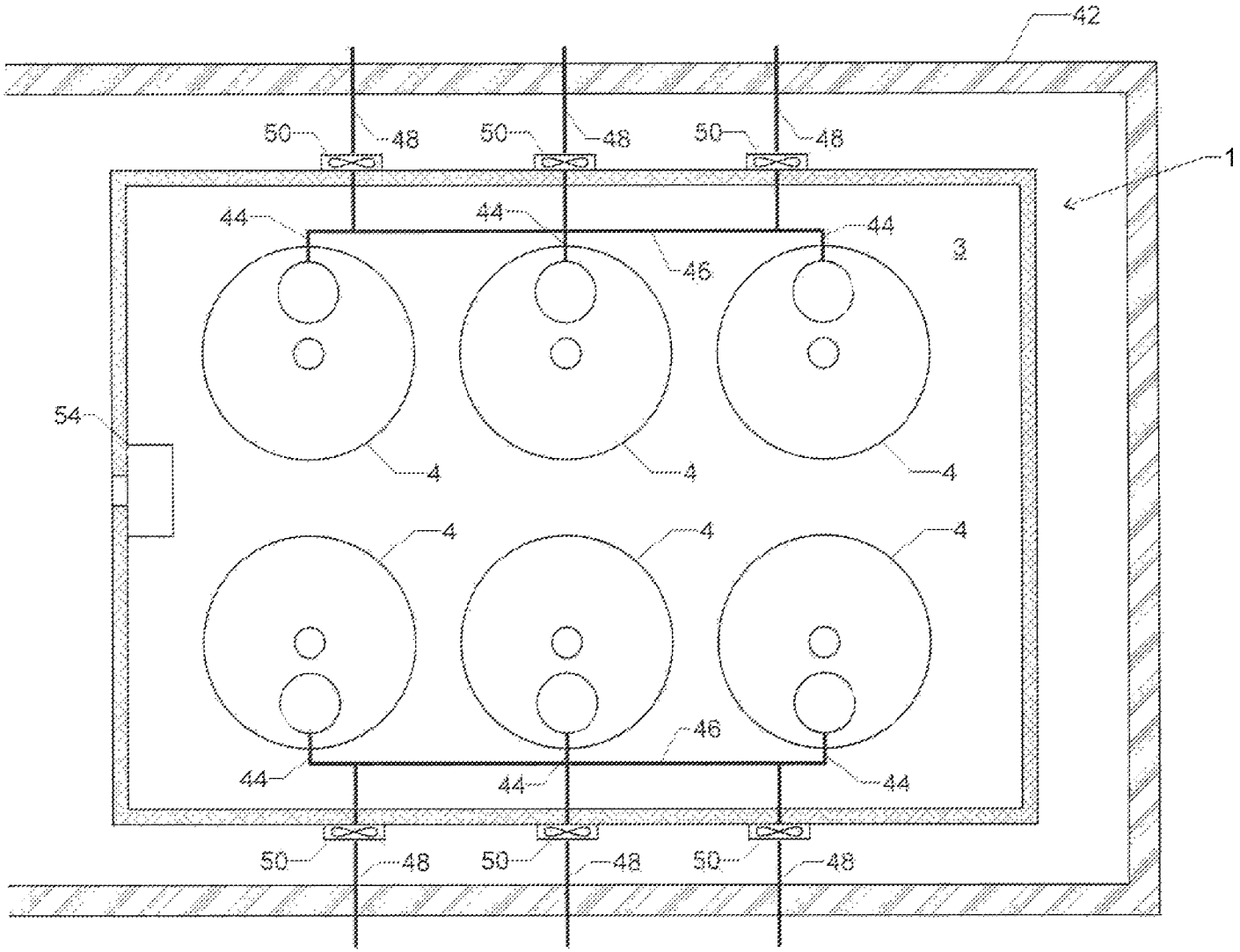
FIG. 4 shows a schematic view of the chamber in a building and of a nitrogen withdrawal apparatus.

In order to prevent evaporated nitrogen from entering chamber 3, the pumps 50 are operated to maintain a slightly lower pressure in the storage tanks 4 than in chamber 3. The pressure differential between chamber 3 and the storage tanks 4 can, however, be low, in the order of a few or a few ten par, Air Drying:

In order to keep the air in chamber 3 dry, a first air processing unit 54 (air drying unit) can be provided, as shown, in FIG. 4.

It is adapted to dry air that is being fed to chamber 3 (e.g. for replacing air drawn off by the nitrogen withdrawal apparatus and for slowly renewing the air in chamber 3 in order to prevent residual nitrogen accumulation), and/or it can be adapted to dry air already within chamber 3, e.g. by circulating it through its dryer portion.

Second Embodiment

Figure 5:
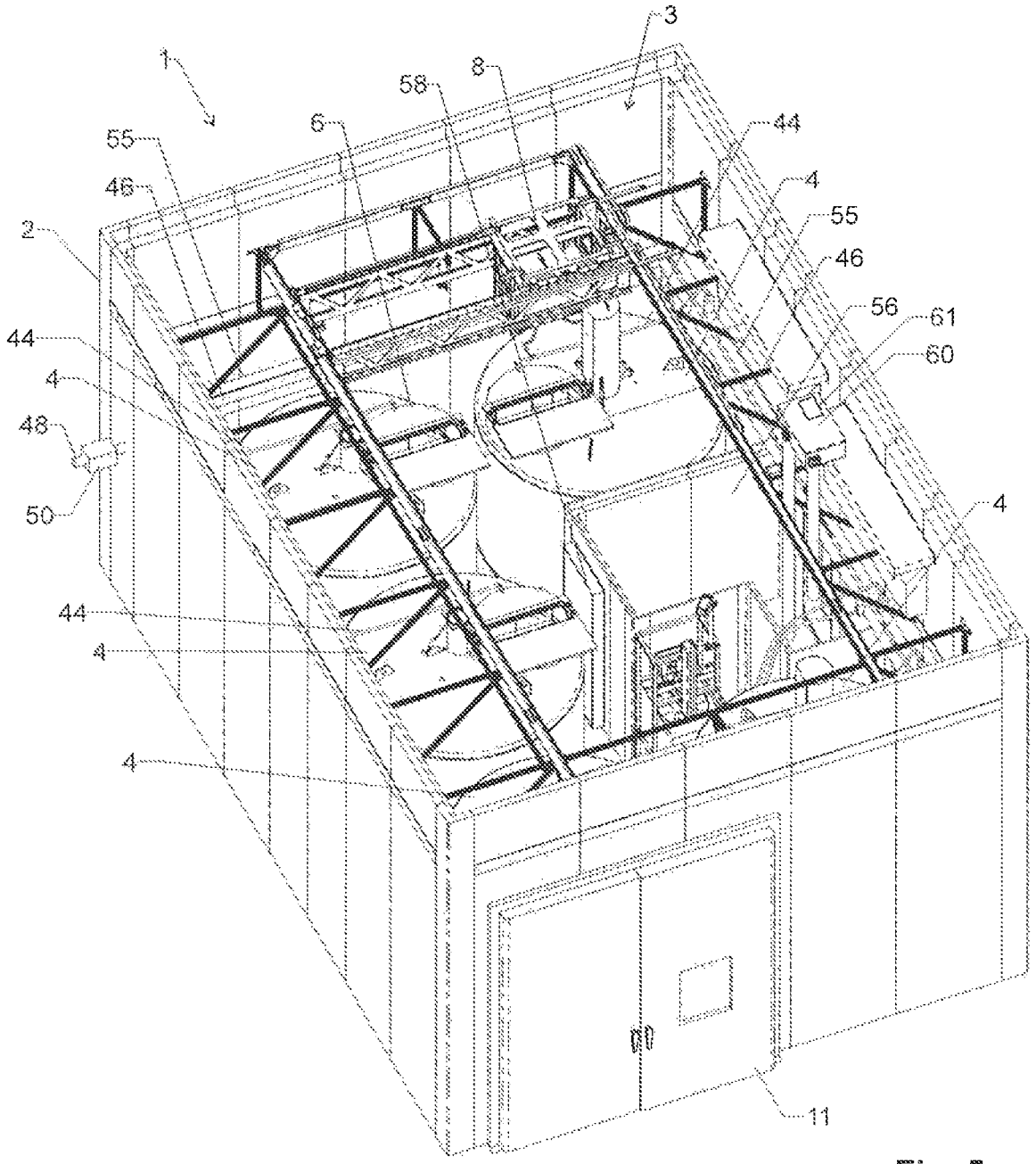
FIG. 5 shows a second embodiment of a storage plant.

FIG. 5 shows a second embodiment of a storage plant 1. It again has an insulating wall 2 enclosing a chamber 3 and at least one storage tank 4 arranged in chamber 3. In this embodiment, there are five storage tanks 4.

Storage plant 1 again comprises a handling device 8 arranged above the storage tanks 4, In this embodiment, the withdrawal ducts 44 are connected to the access openings 6 of the storage tanks 4, and there is one common manifold 46 for all of them.

FIG. 5 also shows one of the exhaust ducts 48 leading off from manifold 46 and a pump 50 for actively carrying off the exhaust gases.

Further, FIG. 5 shows a liquid nitrogen feed tube 55, through which liquid nitrogen is fed to all the storage tanks 4.

In the embodiment of FIG. 5, storage plant 1 comprises, in addition (or alternatively) to the large maintenance door 11, an outer user door (not shown) that leads to an airlock 56 and from there to an inner user door 58.

A second air processing unit 60 (air drying unit) can be provided for processing the air in chamber 3. Air processing unit 60 can perform one or more of the following function:

a) It can cool the air in airlock 56, b) It can dry the air in airlock 56, c) It can discharge air from airlock 56 and replace it with fresh air to keep nitrogen levels low. In that case, if the air processing unit 60 also provides cooling functionality a), it advantageously comprises a heat exchanger 61 to transferring heat from the fresh air to the air to be discharged.

Notes:

In the embodiment of FIG. 4, the exhaust ducts 48 are shown to be one-piece ducts directly leading all the way outside the building. Alternatively, the exhaust ducts 48 may consist of a combination of dedicated tubes leading away from chamber 3 and an air transport duct of the building itself, where the tubes are connected to the air transport duct and the latter finally conveys the nitrogen away from the building, The air dryer units 54 are advantageously designed to not only dry the air in chamber 3 and/or airlock 56, but they can also be equipped to feed fresh air to chamber 3 and/or to airlock 56 in order to maintain a certain amount of air exchange, thereby preventing a build-up of residual nitrogen in chamber 3 and/or airlock 56. In other words, the air dryer unit 54 is advantageously designed to intake fresh air from outside storage plant 1, to cool and dry said air, and to feed it into storage plant 1.

Chamber cooling unit 9*a* may be part of air dryer unit 54.

The storage plant shown here can be e.g., used to store laboratory objects, such as blood and tissue samples, sperm probes, and other biological and/or chemical samples.

The operation of the nitrogen withdrawal apparatus prevents excess nitrogen from forming within chamber 3.

While there are shown and described presently preferred embodiments of the invention, it is to be distinctly understood that the invention is not limited thereto but may be otherwise variously embodied and practiced within the scope of the following claims.

The invention claimed is:

1. A method for operating a storage plant in a building, where the storage plant includes a chamber having a cooled interior, at least one storage tank arranged in said chamber for receiving objects to be stored, the at least one storage tank being cooled with liquid nitrogen, and a nitrogen withdrawal apparatus that includes at least one withdrawal duct connected to a top section of the at least one storage tank, at least one exhaust duct extending away from said chamber, and at least one pump operable to move gaseous nitrogen from the at least one storage tank through said withdrawal duct and said exhaust duct for conveying the gaseous nitrogen away from the chamber, the method comprising:

conveying gaseous nitrogen from said at least one storage tank out of said building using said nitrogen withdrawal apparatus; and maintaining a lower pressure in the at least one storage tank than in the chamber via the at least one pump.

2. The method of claim 1 wherein a temperature (Tc) in the chamber is maintained below 0° C.

3. The method of claim 1 wherein a temperature (Tc) in the chamber is maintained between −50° C. and −20° C.

4. The method of claim 1 wherein a temperature in said at least one storage tank is maintained below −160° C.

* * * * *